United States Patent [19]

Jenkins

[11] 4,433,519

[45] Feb. 28, 1984

[54] SIMULATED LOG CONSTRUCTION ELEMENT

[76] Inventor: Thomas A. Jenkins, Box 502, Bismarck, N. Dak. 58502

[21] Appl. No.: 266,668

[22] Filed: May 26, 1981

[51] Int. Cl.[3] ..... E04B 1/10; E04B 1/74; E04C 1/10

[52] U.S. Cl. ..... 52/233; 52/404; 52/580

[58] Field of Search ..... 52/233, 404, 405, 561, 52/562, 524, 525, 526, 577, 578, 580, 581, 583, 313, 316, 588, 537, 536, 538, 539; 46/20, 19, 26, 29

[56] References Cited

U.S. PATENT DOCUMENTS

| | | | |
|---|---|---|---|
| 1,971,994 | 8/1934 | Smith | 46/20 |
| 2,040,110 | 5/1936 | Tahvonen et al. | 52/233 |
| 2,045,482 | 6/1936 | Maier | 52/316 |
| 2,387,487 | 10/1945 | Abeles | 52/536 |
| 2,787,029 | 4/1957 | Johnson | 52/233 |
| 3,189,950 | 6/1965 | Johnson | 20/4 |
| 3,377,758 | 4/1968 | Witschnig | 52/233 |
| 3,742,665 | 7/1973 | Henry | 52/233 |
| 3,969,859 | 7/1976 | Hisey | 52/233 |
| 3,992,838 | 11/1976 | Vizziello | 52/233 |
| 4,056,906 | 11/1977 | Elfstrom | 52/233 |
| 4,147,000 | 4/1979 | Lewandowski | 52/233 |
| 4,305,238 | 12/1981 | Harward et al. | 52/233 |
| 4,309,851 | 1/1982 | Flagg | 52/233 |
| 4,312,161 | 1/1982 | Goldade | 52/233 |

*Primary Examiner*—Alfred C. Perham

*Attorney, Agent, or Firm*—Kinney, Lange, Braddock, Westman and Fairbairn

[57] ABSTRACT

A hollow cylindrical prefabricated modular construction element is formed by generally circular supports and a sheath. These hollow cylinders are connected, using simple carpentry tools, at a building site to create walls, having a simulated log appearance.

13 Claims, 14 Drawing Figures

SIMULATED LOG CONSTRUCTION ELEMENT

BACKGROUND OF THE INVENTION

1. Field of the Invention

The present invention relates to prefabricated modular construction elements.

2. Description of the Prior Art

It has been proposed in the prior art to insulate regular building logs. See, for example, the following patents:

U.S. Pat. No. 2,040,110 to Tahvonen;
U.S. Pat. No. 3,189,950 to Johnson;
U.S. Pat. No. 3,969,859 to Hisey;
U.S. Pat. No. 3,992,838 to Vizziello; and
U.S. Pat. No. 4,147,000 to Lewandowski.

All of these attempt to improve normal loghouse construction by adding insulation.

It has also been proposed in the prior art to create simulated log buildings by building walls of support parts and encasing them in parts of cylinders. See, for example, U.S. Pat. No. 2,787,029 by Johnson and U.S. Pat. No. 3,377,758 by Witschnig. Both of these former methods have serious disadvantages. The construction suggested in the Johnson patent requires longitudinal support parts that connect an entire wall before the cylinders are created. This method requires much construction at the building site. The hollow log exterior is merely asphalt material material installed for appearance and weather-proofing, and is not part of the support wall. This has two major problems. First, it requires that a metal lath be installed first, which means extra work at the building site, and second, the asphalt provides no structural strength for the wall.

The method suggested in the Witschnig patent is to cut portions of the cylinder from actual logs. The cylinders are then connected to frame construction supports. This had two major disadvantages. First, much work must be done at the building site. Many tools are needed at the site to first buiid the support wall and then connect the cylinder parts. Second, sawed wood cylinder portions, as the construction element, have some disadvantages. The cylinder parts are liable to crack or warp.

SUMMARY OF THE INVENTION

The present invention is a modular construction element which simulates the look of a log building. The construction element is capable of construction in a factory and shipment in modular form to a building site, where it can be connected to other construction elments, with a minimum of tools, to form a wall or construction unit. The invention includes circular or semicircular supports at least partially enclosed by and connected to rigid sheath elements. The modular construction element is a generally hollow cylinder having at least one curved side, so that a wall constructed from the modular construction elements has a log-like appearance.

In preferred embodiments, the present invention comprises a plurality of longitudinally spaced supports having a bottom with a generally convex portion, a top with a generally concave portion, and at least one convex curved side; a formed sheath at least partially enclosing and attached to the supports to form an at least partially circular hollow cylinder; and a flange attached to the sheath for engagement with and attachment to another construction element.

In the construction of a wall, one modular construction element is placed against another modular construction element by fitting a convex bottom of one construction element against a concave top of another. The sheath elements are then attached to each other to form a rigid wall.

FIG. **9*a*** is a cross section of a wall formed by assembled and connected construction elements, which have one curved side, attached to standard wall board.

Figure 10:
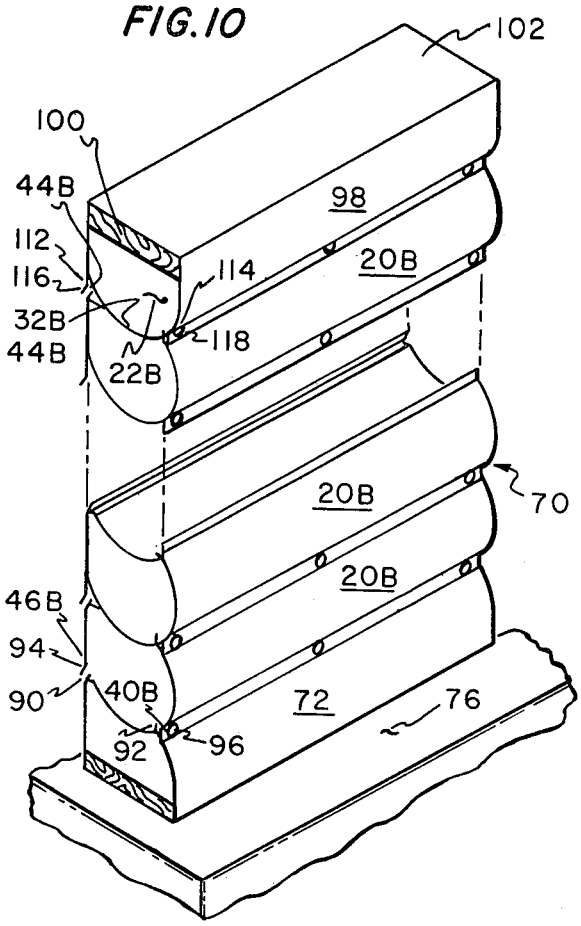

FIG. 10 is a perspective view of an assembled wall showing the use of a base unit and a top unit.

Figure 11:
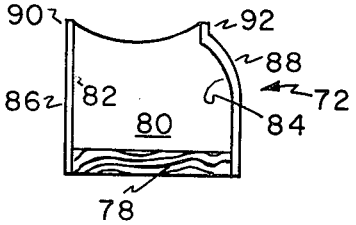

FIG. 11 is a cross-sectional view of the base unit shown in FIG. 10.

Figure 12:
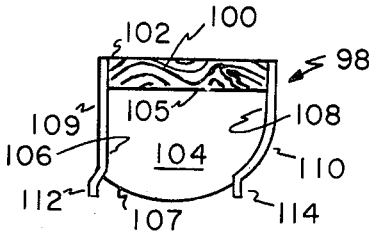

FIG. 12 is a cross-sectional view of the top unit shown in FIG. 10.

Figure 13:
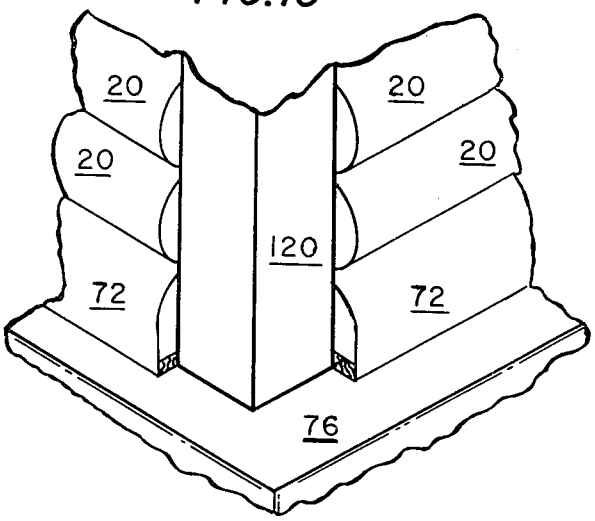

FIG. 13 shows a construction of a corner using a corner post against which wall units abut.

DETAILED DESCRIPTION OF PREFERRED EMBODIMENTS

Figure 1:
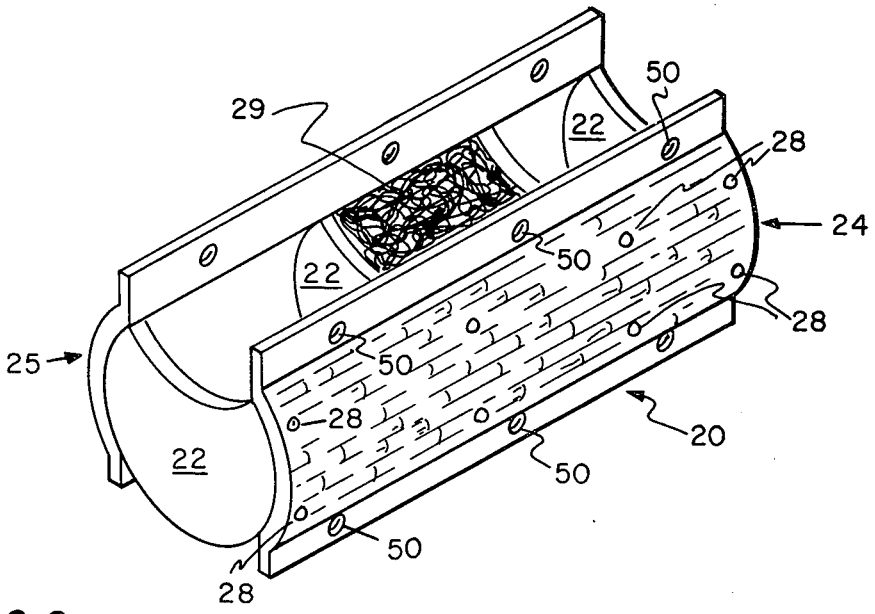
FIG. 1 is a perspective view of an assembled construction element of one preferred embodiment of the present invention.

FIG. 1 shows a perspective view of one preferred embodiment of modular construction element 20 of the present invention. Element 20 is created by aligning two or more supports 22 parallel to each other along a longitudinal axis. The supports 22 are then enclosed by sheath parts 24 and 25. Sheaths 24 and 25 enclose and are attached to opposite sides of supports 22 by fasteners 28, which are preferably nails, screws, adhesive, or other suitable means of fastening.

Prefabricated construction element 20 is a generally circular hollow cylinder. This is the basic construction element to be used at building sites to construct walls or other construction units having the appearance of log construction.

In the preferred embodiments of the present invention, the generally hollow interior of construction element 20 is filled with insulation 29, as illustrated in one cavity of element 20 shown in FIG. 1. Insulation 29 is preferably fiberglass, synthetic polymer foam, or other insulating material having a high R value. Depending upon the particular configuration of element 20 and the needs and desires of the builder, insulation 29 is introduced into element 20 either at the factory where element 20 is manufactured or at the building site.

Figure 2:
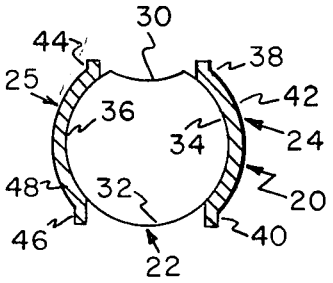
FIGS. 2 through 7 are cross-sectional views of various alternative embodiments of assembled construction elements.

A cross section view of modular construction element 20 of FIG. 1 is shown in FIG. 2. The support 22 has concave top 30 and bottom convex side 32 and first and second convex sides 34 and 36. The convex bottom 32 of one construction element 20 will fit into and mate with the concave top 30 of an abutting construction element 20, when two modular construction elements are stacked. In this embodiment, sheath 24 includes top flange 38, bottom flange 40, and curved central portion 42 which generally conforms to first surface 34 of support 22. Flanges 38 and 40 connect to flanges of abutting construction elements when a wall is constructed by stacking elements 20. Similarly, sheath 25 includes top flange 44, bottom flange 46, and curved central portion 48 which generally conforms to second surface 36 of support 22. As shown in FIG. 1, flanges 38, 40, 44 and 46 each preferably include a plurality of mounting holes 50 for fasteners (not shown) which connect the overlapping flanges of adjacent modular construction elements.

Other embodiments of the modular construction element of the present invention are shown in FIGS. 3 through 7. In these figures, numerals similar to those used in FIGS. 1 and 2 are used to designate similar elements.

Figure 3:
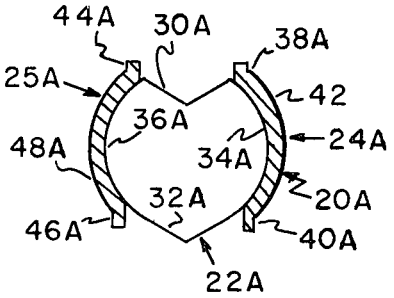

FIG. 3 shows element 20A with a V-shaped top 30A and bottom 32A.

Figure 4:
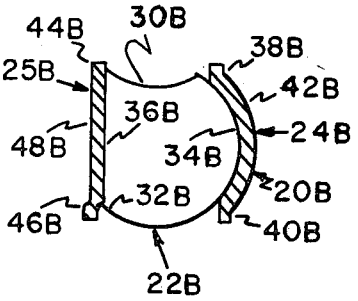

FIG. 4 shows element 20B in which support 22B has generally circular convex first side 34B and generally flat second side 36B. Sheath 25B has generally flat central portion 48B which conforms to flat second side 36B. This embodiment is for those who prefer the log-like appearance on only one side of the wall.

Figure 5:
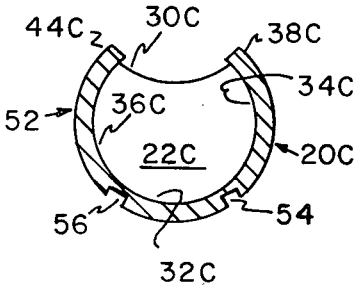

FIG. 5 shows construction element 20C in which sheath 52 covers essentially the entire cylinder, and thus replaces the individual sheaths 24, 25 shown in FIG. 2. As shown in FIG. 5, sheath 52 covers and conforms to convex bottom 32C and convex sides 34C and 36C, and leaves concave top 30C exposed. Sheath 52 has protruding top flanges 38C and 44C and notches 54 and 56 near its bottom. When elements 20C are stacked, flanges 38C and 44C of a lower element 20C fit into 54 and 56, respectively, of an element 20C immediately above.

Figure 6:
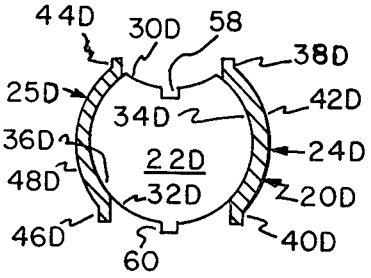

FIG. 6 shows a cross section of element 20D, in which concave top 30D includes notch 58 and convex bottom 32D includes downwardly projecting pin 60. In this embodiment, when elements 20D are stacked, pin 58 of one element 20D fits into notch 60 of the element 20D immediately below.

Figure 7:
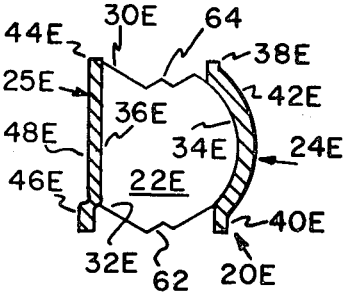

FIG. 7 shows element 20E having semicircular support 22D with V-shaped notch 62 in convex bottom 32E and V-shaped appurtenance 64 in convex top 30E, so that construction elements 20E nest snugly when stacked.

In the preferred embodiments of the present invention, like those illustrated in FIGS. 1 through 7, the sheaths 24,25 are preferably fabricated from fiberglass, metal, plastic, molded wood products, or other material having structural rigidity. This is a great advantage over the prior art structures shown in the Johnson and Witschnig patents where asphalt and wood slices were used as outside materials. In the figures, the thickness of sheaths 24,25 has been exaggerated for clarity.

In the present invention, which uses rigid sheath material, the modular construction element can be fabricated at the factory and shipped as a unit, thereby greatly reducing the amount of time and skill needed for assembly at the site.

Figure 8:
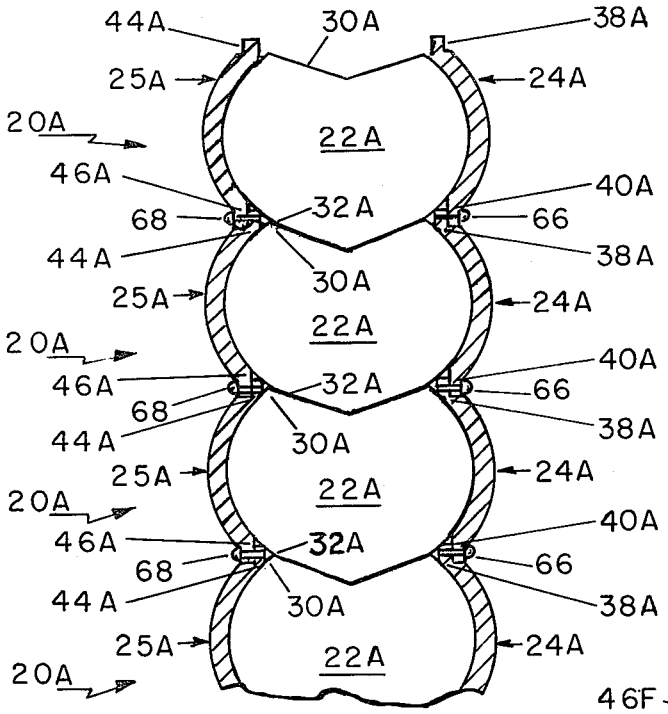
FIG. 8 is a cross section of a wall formed by assembled and connected construction elements of one embodiment of the present invention.

FIG. 8 shows a cross section of a portion of a construction unit made by stacking and attaching modular construction elements 20A of FIG. 3. Convex bottoms 32A of each support 30A of each element 20A nest into mating concave tops 30A of the element 20A below. Glue or other bonding material (not shown) preferably bonds tops 30A and bottoms 32A together. Bottom flanges 40A and 46A lap over and outside of top flanges 38A and 44A, respectively, of the element below. This overlap prevents moisture from running down the wall and entering the joint between top flanges 38A and 44A and bottom flanges 40A and 46A. Flanges 38A and 40A are attached by fasteners 66, and flanges 44A and 46A are attached by fasteners 68, thereby forming a rigid structural unit.

Figure 9:
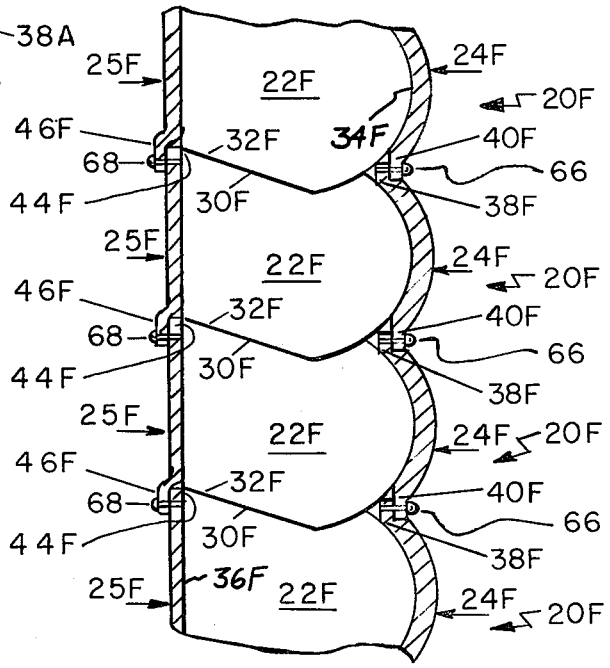
FIG. 9 is a cross section of a wall formed by assembled and connected construction elements which have one flat side and one curved side.

FIG. 9 shows a cross section of a wall constructed of stacked construction elements 20F which have one flat side 36F and one curved surface 34F. Convex bottom 32F of element 20F nests into concave top 30F of the element 20F below. Bottom flanges 46F and 40F lap over and outside of top flanges 44F and 38F of the element 20F below. Flanges 38F and 40F are attached by fasteners 66 and flanges 44F and 46F are attached by fasteners 68, thus forming a rigid structural unit.

Figure 9A:
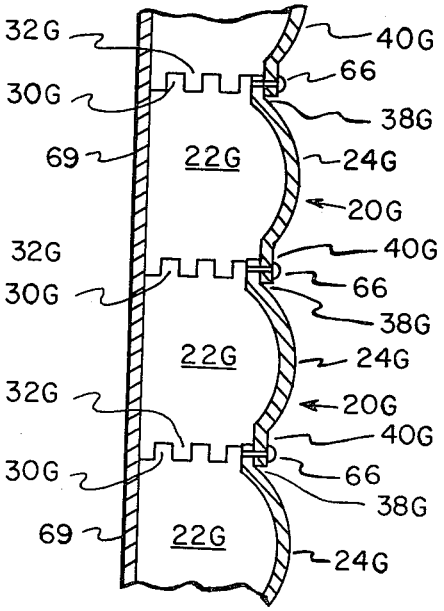

FIG. 9A shows a cross section of a wall constructed of stacked construction elements 20G which have only one sheath 24G. Top 30G and bottom 32G have a mortise-and-tenon surface. When two elements 20G are stacked, the mortise-and-tenon surface of bottom 32G of the upper element 20G interlocks with the mortise-and-tenon surface of top 30G of the lower element 20G. Flanges 38G and 40G are attached by fasteners 66. The assembled construction elements 20G are then attached to wall board 69, forming a rigid structural unit.

FIG. 10 shows a perspective view of wall 70 made from construction elements 20B (of FIG. 4) which are stacked. Wall 40 is begun by laying base unit 72 on foundation 76. Foundation 76 may be pillars, concrete blocks, poured concrete slab, or any other foundation method that is suitable to the site. Base unit 72, which is shown in further detail in FIG. 11, is generally similar to construction element 20B, except that it has flat solid base 78 at its bottom. Base 78 is, for example, nominal two-inch construction lumber. Attached to base 78 is support 80. Support 80 has flat side 82 and curved side 84. Base unit 72 also includes sheaths 86 and 88. Sheath 86 is attached to flat side 82 and to base 78. Sheath 88 conforms to and its attached to curved side 84 of support 80, and is attached to base 78. Sheath 86 has upper flange 90 and sheath 88 has upper flange 92. Flanges 90 and 92 fit under and attach to flanges 46B and 40B, respectively, of construction element 20B which is stacked on top of base unit 72. Flanges 46B and 90, and flanges 40B and 92, are then attached by fastening means 94 and 96, respectively. Each successive construction element 20B is then placed upon and attached to construction element 20B below. Finally, when the desired height is reached, top unit 98 is placed at the top of wall 70.

As shown in further detail in FIG. 12, top 100 of top unit 98 is made of material fit for attaching a roof, such as nominal two-inch construction lumber. Top surface 102 of top unit 98 is flat and is suitable for attaching roof joists. Attached to top 100 is support 104, which has flat top 105, flat side 106, convex bottom 107 and curved side 108. Sheath 109 is attached to support 104 and top 100. Sheath 110 conforms in shape to curved side 108. Sheath 110 is attached to support 104 and top 100. Sheath 109 has flange 112 and sheath 110 has flange 114. Flange 112 overlaps and is attached by fastening means 116 to flange 44B of the construction element 20B immediately below top unit 98. Similarly, flange 114 overlaps and is attached by fastening means 118 to flange 38B of the construction element 20B immediately below.

Once top unit 98 is attached, wall 70 is complete. Roof construction may then be attached to top surface 102.

Various methods can be used for adjoining these construction units to form a building. One embodiment of corner construction is shown in FIG. 13. A vertical post or column 120 is attached to foundation 76. Construction units 20, bottom units 72, and top units 98 (not shown in FIG. 13) are abutted to and attached to column 120 to form a corner.

An overlap arrangement can also be used, simulating the corner of an old-fashioned log house. In this embodiment, an end construction element bottom has top notches which nest when two construction elements are placed perpendicular to each other.

If construction elements 20 do not span the needed length, they can be abutted. In one preferred embodiment, the sheath parts 24 and 25 of construction element 20, overlap and attach to the sheath parts 24 and 25 of the abutted construction element 20.

This wall construction method has great advantages over any prior art methods. The wall can be constructed easily at the site merely by attaching these log-like cylinders. Only elementary carpentry tools, such as hammer and screwdriver, are needed to complete the operation. A stud wall or support wall need not be built first. The entire wall is created by assembling the construction elements.

I claim:

1. A construction unit comprising:

a plurality of prefabricated modular construction elements positioned adjacent one another in stacked parallel relation, each construction element comprising:

a plurality of longitudinally spaced supports, each support having a top, a bottom, a first convex curved side, and a second side opposite the first side, the tops of the supports of one modular construction element being located to be adjacent the bottoms of the supports of a modular construction element stacked above;

rigid sheath means at least partially enclosing and attached to the supports to form an at least partially circular and generally rigid hollow cylinder capable of independently bearing structural weight;

upper flange means integral with and extending upward from the sheath means along generally the entire length of the cylinder; and lower flange means integral with and extending downward from the sheath means along generally the entire length of the cylinder, the lower flange means being positioned to engage in overlapping relationship to the upper flange means of an adjacent parallel modular construction element; and means for fixedly connecting the upper flange means of one modular construction element with the lower flange means of an adjacent modular construction element stacked above so that the supports of the stacked elements are aligned in stacked relation to provide vertical strength and the sheath means of the stacked elements are attached together to form a rigid wall.

2. The construction unit of claim 1, wherein each support has a recess in its top and a pin protruding from its bottom for insertion into the recess in the top of a support of an adjacent modular construction element.

3. The construction unit of claim 1, wherein each construction element is filled with insulation material.

4. The construction unit of claim 3 wherein the insulation material is synthetic polymer foam.

5. The prefabricated construction element of claim 1, wherein the top is generally a V-shaped notch.

6. The prefabricated construction element of claim 1, wherein the bottom has a V-shaped notch and the top has a matching appendage.

7. The prefabricated construction element of claim 1, wherein the sheath means comprises first and second sheaths attached to the first and second sides, respectively.

8. The prefabricated construction element of claim 1, wherein the sheath means comprises a sheath which extends from an intersection of the top and the first side around the bottom and to an intersection of the top and the second side.

9. The prefabricated construction element of claim 8, wherein the sheath has a longitudinal groove means for receiving the flange means of an adjacent construction element.

10. The construction unit of claim 1, wherein the second side is a convex curved side.

11. The construction unit of claim 1, wherein the second side is substantially flat.

12. The construction unit of claim 1, wherein the bottom has a generally convex portion and wherein the top has a generally concave portion.

13. A method for constructing a structural unit from a plurality of essentially identical prefabricated modular construction elements, the method comprising:

providing a first hollow generally cylindrical modular construction element, said element comprising a plurality of longitudinally spaced supports, each support having a top with a concave portion, a bottom of a convex shape, and at least one curved side, rigid sheath means at least partially enclosing and attached to the supports to form an at least partially circular and generally rigid hollow cylinder and first and second flange means integral with and extending from the sheath means along generally the entire length of the cylinder;

placing a second hollow cylindrical modular construction element of essentially identical construction to the first element against the first element with the convex bottom of the supports of the second element aligned with the concave top of the supports of the first element, and with the first flange means of the first element in overlapping relationship to the second flange means of the second element; and connecting the first flange means of the first element with the second flange means of the second element.

* * * * *